United States Patent [19]

Setliff

[11] Patent Number: 4,836,065

[45] Date of Patent: Jun. 6, 1989

[54] RADIATOR CAP REMOVAL TOOL

[76] Inventor: Tyrus W. Setliff, 625 E. Estavan, Apache Junction, Ariz. 85219

[21] Appl. No.: 188,920

[22] Filed: May 2, 1988

[51] Int. Cl.[4] ..... B25P 13/02

[52] U.S. Cl. ..... 81/124.2; 81/176.2; 81/3.4

[58] Field of Search ..... 81/124.2, 176.1, 176.15, 81/176.2, 3.4, 344; 251/291; 220/DIG. 32, 206

[56] References Cited

U.S. PATENT DOCUMENTS

| | | | |
|---|---|---|---|
| 1,518,222 | 12/1924 | Sather . | |
| 1,866,125 | 7/1932 | Patterson . | |
| 2,761,338 | 9/1956 | Hardy | 81/3.38 |
| 3,007,357 | 11/1961 | Nalley | 81/3.4 |
| 4,406,182 | 9/1983 | Antone | 81/3.38 |
| 4,527,450 | 7/1985 | Drosky | 81/3.29 |
| 4,569,259 | 2/1986 | Rubin et al. | 81/176.15 |

*Primary Examiner*—Frederick R. Schmidt
*Assistant Examiner*—Lawrence Cruz
*Attorney, Agent, or Firm*—Brown, Martin, Haller & McClain

[57] ABSTRACT

An apparatus for removing a radiator cap having a handle, a housing open at one end and closed at another end with the handle attached to the housing at the housing closed end. The housing engages a radiator cap at the housing open end. The housing further includes notches formed at the housing open end for receiving the ears of a radiator cap. A pressure relief valve engagement member may be disposed within the housing for engaging a radiator cap pressure relief valve.

11 Claims, 1 Drawing Sheet

RADIATOR CAP REMOVAL TOOL

BACKGROUND OF THE INVENTION

I. Field of the Invention

The present invention relates to engine hand tools. More specifically, the present invention relates to a novel and unique device for safely removing the radiator cap from an engine coolant system radiator.

II. Description of the Related Art

Automobile and truck engines typically include fluidic coolant systems for maintaining engine temperature within a predetermined temperature range. These systems typically include a radiator through which the coolant fluids flow. The radiator acts as heat exchanger for removing heat transferred to the coolant fluids from the engine. Most automobile and truck coolant systems are typically pressurized sealed systems during operation. After operation, the system may remain pressurized until cooled down.

On occasion, one may desire to remove the radiator cap for inspection or service of the radiator or coolant system. In many cases it is difficult to physically unscrew the radiator cap from the radiator filler neck. Difficulties in removal of the radiator cap may be experienced due to pressure, corrosion, damage or various other reasons.

In certain cases, it is desired to remove the radiator cap while the coolant system is still heated and pressures are built up within the coolant system. However, under these conditions, removal of the radiator cap is particularly dangerous to the individual. Hot gases, steam and heated coolant fluids may be released from the pressurized coolant system upon removal of the radiator cap from the filler neck. Previously, many individuals have attempted to remove the radiator cap using a rag placed over the radiator cap prior to removal. However, the chances of heated steam and fluids contacting the individual still remain. The use of rags and other tools not specially fitted for removal of the radiator cap may still provide insufficient torque required to rotate the cap for relief from the filler neck.

It is, therefore, an object of the present invention to provide a radiator cap removal tool for safely and easily removing a radiator cap from a radiator filler neck.

SUMMARY OF THE INVENTION

The present invention is a device for removing a radiator cap mounted upon an engine coolant system radiator at the radiator filler neck. The tool of the present invention comprises a housing for engaging the radiator cap and a handle coupled to the housing for rotating the housing. The handle consists of an elongated cylindrical shaft having a substantially perpendicular crossmember formed at one end. The other end of the handle is externally threaded with left-hand or reverse threads. The handle is mounted to a substantially cylindrical, hollow housing having a side wall, an open top end and a closed bottom end with the bottom end having an end wall attached to the side wall. The side wall has a pair of radially aligned notches formed at the top end. An internally threaded boss is mounted at the housing exterior of the end wall with the threads of the handle mating with the boss internal threads. A pressure relief valve engagement member is disposed upon the end wall interior to the housing.

The handle is removably coupled to the housing for easy storage and for use with interchangeable heads of varying sizes. The handle and boss are reverse threaded to permit fixed engagement of the handle and housing when unscrewing a radiator cap mounted upon a radiator filler neck. The pressure relief valve engagement member is positioned within the housing and extends slightly above the bottom ledges of the notches toward the socket open end. The extension of the engagement member beyond the notch bottom ledges permits contact with the radiator cap pressure relief valve prior to engagement of the notch bottom ledges with the top of the radiator cap. Depression of the pressure relief valve by the engagement member prior to engagement of the housing upon the cap permits the release of any pressure build-up within the radiator to safely escape without injury to the individual.

BRIEF DESCRIPTION OF THE DRAWINGS

These and other features, objects and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Figure 1:
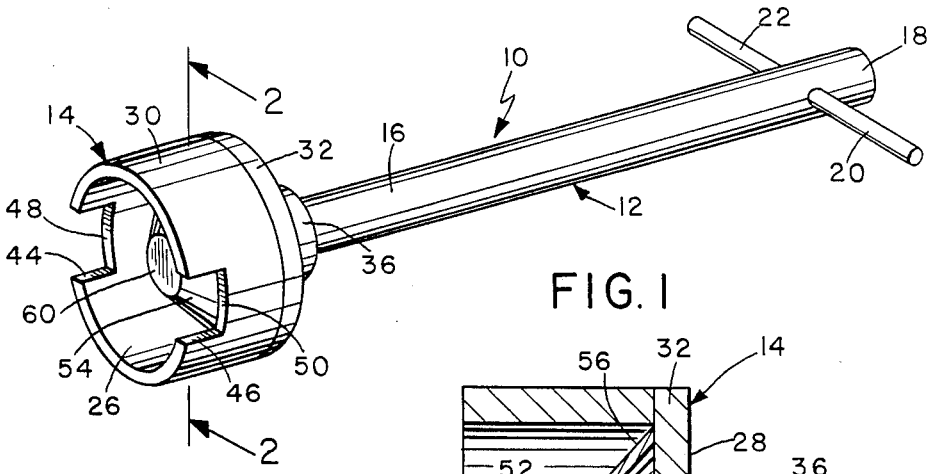
FIG. 1 is a perspective view of the radiator cap removal tool of the present invention.
Figure 2:
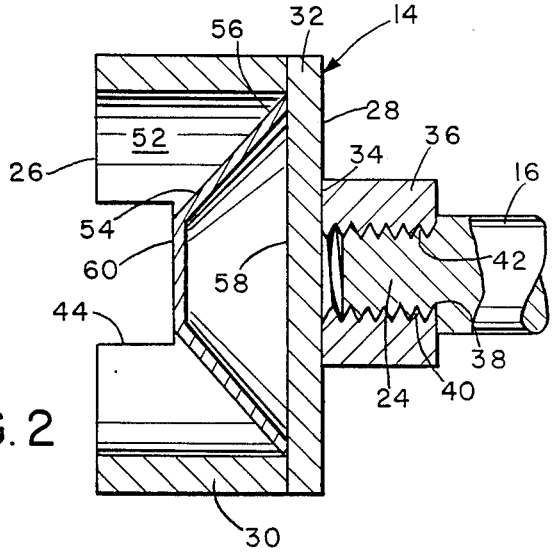
FIG. 2 is an enlarged sectional view taken on line 2—2 of FIG. 1.

Referring to FIGS. 1–2 of the drawings, radiator cap removal tool 10 is comprised of a substantially T-shaped handle 12 and a cylindrical housing 14. Handle 12 is comprised of an elongated cylindrical shaft 16 having adjacent one end, end 18, a pair of crossmembers 20 and 22. Crossmembers 20 and 22 are perpendicular to a central axis of shaft 16 and are radially aligned on opposite sides of shaft 16. Crossmembers 20 and 22 may be individually affixed to shaft 16. In the alternative, a single unitary crossmember may extend through a radial throughbore (not shown) in shaft 16. The ends of the unitary crossmember may be enlarged, such as by pinching, to prevent removal of the crossmember from throughbore. Although shaft 16 and crossmembers 20 and 22 are illustrated as one form of enabling the operator to twist socket 14, many various other types of handles, or shaft ends may be utilized. For example, shaft 16 may have mounted at end 18 a single crossmember, such as only crossmember 20, to provide an L-shaped configuration. In the alternative, end 18 may have D-shaped structure to form a hand hold.

The other end of shaft 16, end 24, is coupled to housing 14. Housing 14 is open at one end, end 26, and closed at the other end, end 28, with handle 12 coupled to socket 14 at closed end 28. Housing 14 is a substantially cylindrical, hollow housing formed by side wall 30 and an end wall 32. End wall 32 intersects side wall 30 to form closed end 28.

Referring to FIG. 2, formed on an exterior surface of end wall 32, surface 34, is a cylindrical boss 36 which has a central axial opening 38. Opening 38 has internal threads 40 which mate with threads 42 at end 24 of shaft 16. Threads 40 and 42 are reverse or left-hand threads to permit counterclockwise removal of the radiator cap from the radiator filler neck with secure engagement of shaft 16 to boss 36.

It is preferred that handle 12 be removably coupled to housing 14 for several reasons. One reason is to permit easy, compact storage of tool 10. Another reason is to permit handle 12 to be used interchangeably with varying sizes of sockets 14 for various sized radiator caps.

Although shaft 16 and boss 36 are illustrated as being mated in removable coupling arrangement by threads 40 and 42, other removable coupling arrangements may be implemented. For example, an axial rectangular opening may be formed in boss 36 such that the rectangular extension member of a socket wrench may fit within the opening. Use of a direction selective socket wrench would permit rotation of socket 14 in both clockwise and counterclockwise directions.

Referring again to both FIGS. 1–2, side wall 30 includes a pair of radially aligned notches 44 and 46 which extend from open end towards end wall 32. Notches 44 and 46 respectively terminate at bottom ledges 48 and 50. Side wall 30 is of a diameter and thickness to permit the housing 14 to mount over the body of a conventional radiator cap. The conventional radiator cap has ears which are thus engaged within notches 44 and 46.

Mounted within interior 52 of socket 14 is a rigid pressure relief valve engagement member 54. As illustrated in FIGS. 1 and 2, engagement member 54 is typically frusto-conical shaped having a base 56 mounted upon bottom wall interior surface 58. Engagement member 54 has at an end opposite base 56, and parallel to surface 58, contact face 60. Contact face 60 engages the radiator cap pressure relief valve when the tool is used. As tool 10 is illustrated in FIG. 2, shaft 16, boss 36, edge wall 32, side wall 30 and engagement member 54 share a common axis of rotation.

Engagement member 54 as illustrated in FIG. 2 is hollow, but may in other embodiments be solid. Engagement member 54 may be implemented in various other shapes and forms. For example, a resilient spring or a finger-like member may be used to engage the radiator cap pressure relief valve.

Figure 3:
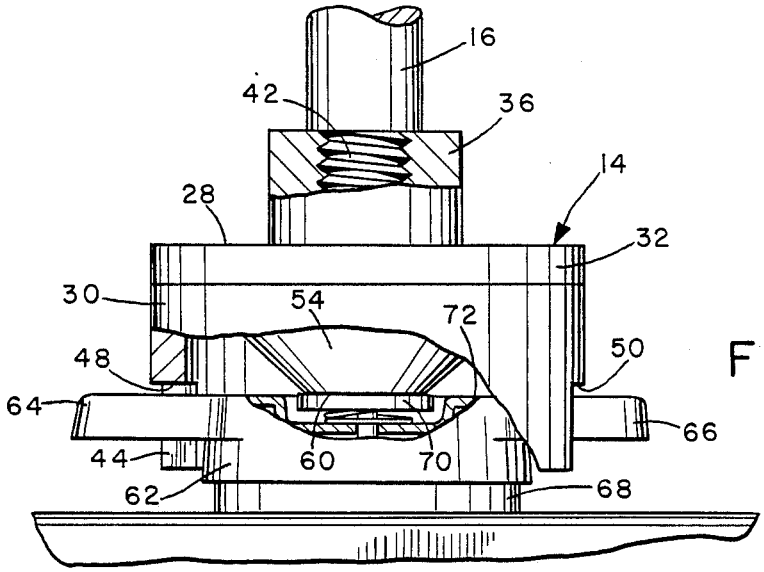
FIG. 3 is a side elevation view, with portions cut away, of the tool applied to a radiator cap.

FIG. 3 illustrates the engagement of tool 10 a generally cylindrical radiator cap 62 which has a pair of radially aligned and protruding ears 64 and 66. Upon placement of tool 10 upon radiator cap 62, radiator cap 62 being mounted upon radiator filler neck 68, contact face 60 engages a centrally located, spring-loaded radiator cap pressure relief valve 70 of radiator cap 62. Since contact face 60 protrudes towards open end 26 beyond notch ledges 48 and 50, contact is made with the pressure relief valve before ledges 48 and 50 contact top surface 72 of radiator cap 62. Depression of tool 10 upon radiator cap 62 engages pressure relief valve 70 so as to permit pressurized steam and fluids to escape, if present in the radiator. The frusto-conical shape of engagement member 54 directs the flow of fluid and gases outwardly then downwardly along the interior of side wall 30 away from the hand of the tool user. Upon the complete depression of tool 10 upon radiator cap 62, the bottom ledges 48 and 50 engage top surface 72. The sides of notches 44 and 46 engage the sides of ears 64 and 66 upon rotation of handle 12. Handle 12 provides additional leverage in rotating cap 62 so as to permit easy removal of cap 62 from filler neck 68.

In one embodiment of the invention, tool 10 may be constructed entirely of a rigid material such as steel. Shaft 16 is constructed of three-quarter inch roundstock steel of an overall length of approximately ten and one-half inches. Crossmembers 20 and 22 are formed of one-quarter inch roundstock steel. Crossmembers 20 and 22 are each one and one-half inch in overall length and are welded to shaft 16 one and one-eighth inch from end 18. Boss 36 is constructed of a three-quarters inch length of roundstock steel of one and one-quarter inch diameter with a five-eighths inch tapped centerbore. Boss 36 is axially aligned and welded to end wall 32. End 24 of shaft 16 further includes a five-eighths inch threaded portion for mating with the tapped bore of boss 36.

End wall 32 is constructed of a one-quarter inch thick by two and seven-eighths inch diameter steel plate. End wall 32 is welded to side wall 30 which is a one-quarter inch thick tubular steel section having an outer diameter of two and seven-eighths inches. Side wall 30 is typically one and one-quarter inches in length. Notches 44 and 46 extend in side wall 30 one-half inch from end 26 towards end wall 32. Notches 44 and 46 are radially aligned approximately one inch in chord width.

Engagement member 54 is a one-eighth inch steel plate formed into frusto-conical shape welded at base 56 to end wall 32. The height of engagement member 54 is slightly over three-quarters inch from base 56 to contact face 60 so as to protrude above bottom ledges 48 and 50 of notches 44 and 46. Base 56 is typically two and seven-eighths in diameter and contact face 60 is also typically seven-eighths in diameter. It is further envisioned that engagement member 54 may be configured as a solid member or any rigid member of a sufficient height and diameter to engage a radiator cap pressure relief valve. For example, engagement member may be implemented as a spring or a solid cylindrical member. In certain other applications, engagement member 54 may be omitted for use with radiator caps without pressure relief valves or the flip-type pressure relief valve.

It is understood that many various modifications to the present invention may be made in terms of fabrication. For example, housing 14 may be integrally formed of a rigid plastic material. Similarly, handle 12 may also be fabricated from a plastic material.

The previous description of the preferred embodiments are provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein, but is to be accorded the widest scope consistent with the principles and novel features disclosed herein.

I claim:

1. A radiator cap removal tool comprising:

a handle;

a housing open at one end and closed at an other end, said handle attached to said housing at said housing closed end, and said housing having notches formed at said open end each for engaging a radiator cap ear; and a pressure relief valve engagement means disposed within said housing for engaging a radiator cap pressure relief valve.

2. The tool of claim 1 wherein said engagement means comprises an engagement member mounted within the interior of said housing at said closed end, said engagement member extending outwardly from within said housing towards said open end and has a contact face positioned above a bottom of each notch.

3. The tool of claim 1 wherein said handle member is removably coupled to said housing.

4. The tool of claim 2 wherein said handle member is removably coupled to said housing.

5. A radiator cap removal tool comprising:

a handle;

a substantially cylindrical, hollow housing having a circumferential side wall, an open end and a closed end closed by an end wall attached to said side wall, said side wall having a pair of radially aligned notches formed at said open end, said end wall having interior and exterior surfaces with said interior surface facing said open end and said exterior surface opposite said interior surface having a boss mounted thereupon with said handle removably coupled to said boss; and a pressure relief valve engagement member disposed upon said end wall interior surface.

6. The tool of claim 5 wherein said handle comprises an elongated cylindrical shaft having a pair of ends with one end for coupling to said boss and the other end having a substantially perpendicular crossmember formed thereat.

7. The tool of claim 6 wherein said boss is internally threaded and said shaft one end is threaded for mating with said boss internal threads.

8. The tool of claim 5 wherein said engagement member is frusto-conical shaped having a base and a contact face at opposite said base, ends thereof mounted upon said end wall interior surface with said contact face facing said open end.

9. The tool of claim 6 wherein said engagement member is frusto-conical shaped having a base and a contact face at opposite ends thereof, said base mounted upon said end wall interior surface with said contact face facing said open end.

10. The tool of claim 9 wherein said handle shaft, said housing side wall and boss, and said engagement member share a common central axis.

11. The tool of claim 8 wherein each notch has a bottom ledge with said contact face protruding above said bottom ledges towards said housing open end.

* * * * *